US005246809A

United States Patent [19]

Funato et al.

[11] Patent Number: 5,246,809

[45] Date of Patent: Sep. 21, 1993

[54] CARRIER FOR A DEVELOPING AGENT

[75] Inventors: Masatomi Funato, Osaka; Hideaki Kawata, Neyagawa; Nobuaki Kawano, Hirakata; Koji Honda, Higashi-Osaka, all of Japan

[73] Assignee: Mita Industrial Co., Ltd., Osaka, Japan

[21] Appl. No.: 812,996

[22] Filed: Dec. 24, 1991

[30] Foreign Application Priority Data

Dec. 28, 1990 [JP] Japan ..... 2-408720

[51] Int. Cl.[5] ..... G03G 9/10

[52] U.S. Cl. ..... 430/108; 430/106.6

[58] Field of Search ..... 430/108, 106.6; 428/407; 252/62.57

[56] References Cited

U.S. PATENT DOCUMENTS 4,965,160 10/1990 Nagatsuka et al. ..... 430/108

5,104,761 4/1992 Saha et al. ..... 430/108

*Primary Examiner*—John Goodrow

*Attorney, Agent, or Firm*—Sherman and Shalloway

[57] ABSTRACT

A magnetic carrier for a two-component type developing agent used for the electrophotography, comprising resin-magnetic spherical particles which are formed by the polymerization of a monomer in which a magnetic powder is dispersed and which have a glass transition temperature of higher than 100° C., the surfaces of said resin-magnetic spherical particles being coated with a surface-treated coating layer. Therefore, the surface-treated coating layer on the surfaces of the carriers can be heat-treated at 100° C. or higher. The carrier therefore is light in weight, flowable, and exhibits excellent durability, resistance against the heat and stable electric characteristics irrespective of the passage of time.

5 Claims, No Drawings

CARRIER FOR A DEVELOPING AGENT

BACKGROUND OF THE INVENTION (1) Field of the Invention

The present invention relates to a magnetic carrier for a two-component type developing agent used for developing electrostatic images in an electrophotography method and the like method. More particularly, the invention relates to a carrier for a developing agent which exhibits excellent properties such as reduced weight, durability, resistance against the heat and resistance against the humidity in combination.

(2) Description of the Prior Art

A two-component type developing agent has been widely used for developing electrostatic images in an electrophotographic method and the like method. The two-component type developing agent uses in combination a toner and a carrier which are electrically charged to opposite polarities relative to each other. When the developing is effected, the carrier is held by a developing agent carrier member while the toner migrates on the electrostatic images to from visible images. Magnetic particles such as an iron powder or sintered ferrite particles are widely used as a carrier which, however, are not yet fully satisfactory with respect to controlling the electrically charging property, reduction in the weight and the flowability.

Furthermore, a carrier of small particles obtained by dispersing and granulating a magnetic powder in a resin of a molten binder has been placed in practical use as a magnetic carrier, yet leaving such a problem that the electrically charging property changes greatly with a change in the environment being caused by magnetic particles that are exposed to the surfaces.

Japanese Patent Laid-Open No. 296157/1987 discloses a carrier for a developing agent obtained by melt-spraying a mixture of a resin and a magnetic powder and granulating it through quenching, and Japanese Patent Laid-Open No. 182668/1988 discloses a carrier for a developing agent obtained by providing the carrier surfaces of the above melt-sprayed granules with a coating layer.

When the carrier surfaces are provided with the coating layer as described above, it becomes necessary to heat-treat the coating layer at a temperature as high as more than 100° C. in order to remove solvents remaining in the coating layer as well as to sufficiently polymerize and cure the coating layer. If this heat-treatment is not sufficiently carried out, the electric characteristics of the carrier such as the amount of electric charging and electric resistance become liable to change with the lapse of time and, further the resistance against the humidity and the resistance against solvents become poor.

According to the above prior art, however, since the carrier for the developing agent makes use of a core prepared based on the melt-spraying method, the heat-treatment effected at a temperature higher than 100° C. for the coating layer causes the core to be melted giving rise to the occurrence of blocking. Or, even if the carrier for the developing agent is prepared, its electrical properties are deteriorated due to agitation and abrasion in the developing device.

SUMMARY OF THE INVENTION

The object of the present invention therefore is to provide a carrier for a developing agent which permits the coating layer applied to the carrier surfaces to be heat-treated at a temperature higher than 100° C. at the time of production, which is light in weight and is flowable, which has durability and resistance against the heat, and which features excellent stability in the electrical properties despite the lapse of time.

According to the present invention, there is provided a carrier for a developing agent which has a surface-treated coating layer formed on the surfaces of a resin-magnetic spherical particles that are formed by polymerizing a monomer in which magnetic particles are dispersed and that have a glass transition temperature of higher than 100° C.

The above surface-treated coating layer is formed on the surfaces of the resin-magnetic spherical particles by the heat treatment at higher than 100° C.

Furthermore, the above monomer in which the magnetic particles are dispersed may preferably be comprised of two or more polymerizable monomers, and a polymer thereof may form a copolymer.

DETAILED DESCRIPTION OF THE INVENTION

According to the present invention, the carrier for a developing agent is obtained by, first, dispersing a magnetic powder in a monomer or in a polymerizable prepolymer, blending, as required, a crosslinking agent or a like agent to carry out the polymerization so that the glass transition temperature becomes substantially 100° C. or higher to form particles of nearly a spherical shape, and forming a surface-treated coating layer on the thus obtained resin-magnetic spherical particles at 100° C. or higher.

It is important that the resin-magnetic spherical particles have a glass transition temperature of higher than 100° C. and, particularly, higher than 120° C. When the resin has a glass transition temperature which is higher than 100° C., the resin-magnetic spherical particles do not develop molten blocking during the heat-treatment of the coating layer, and no change in the physical properties takes place inside the particles, either. Therefore, the carrier maintains the electrically charging property to a sufficient degree and exhibits excellent durability, too.

Moreover, the carrier of the present invention is comprised of the resin-magnetic spherical particles having a glass transition point of higher than 100° C. Therefore, even when the coating layer formed on the surfaces of the resin-magnetic spherical particles is heat-treated at higher than 100° C., the resin particles are not melted and do not develop blocking unlike the conventional carriers for developing agents. Moreover, since the coating layer can be effectively treated at a temperature higher than 100° C. and, particularly, higher than 120° C., the solvents remaining in the coating layer on the surfaces can be removed almost all. Therefore, the carrier exhibits properties that do not change with the lapse of time after preserved or during the use, and maintains predetermined quality over extended periods of time. Moreover, since the coating layer on the surfaces are sufficiently cured by the heat treatment at a high temperature, the carrier exhibits excellent durability, resistance against the heat, resistance against the humidity and flowability and, further, exhibits very stable electrically charging property.

(Monomer)

The monomer in which magnetic particles are dispersed may be a widely known polymerizable monomer that has hitherto been used as a resin for binding the carriers, such as an acrylic monomer, a styrene-type monomer or a like monomer.

In the present invention, it is particularly preferred to use two or more kinds of these polymerizable monomers that can be used alone in combination together to form a copolymer. In addition to the above monomers, there may be suitably used ethyleneically unsaturated fatty acid or, depending upon the cases, small amounts of polyolefins as copolymers.

In carrying out the polymerization, furthermore, it is desired to use the above compounds as polymerizable monomers or as syrup-like prepolymers which are polymerized to some extent, as well as to use crosslinking agents which are known per see which fit to the individual polymerizable monomers, in order to accomplish the object of the invention.

The styrene-type monomer is expressed by a formula $CH_2{=}C(R_1){-}Ph{-}(R_2)_n$, wherein $R_1$ is a hydrogen atom, a lower (less than 4 carbon atoms) alkyl group, or a halogen atom, $R_2$ is a substituent such as a lower alkyl group or a halogen atom, and n is an integer of 2 or greater inclusive of zero. Its examples include a styrene, a vinyltoluene, an α-methylstyrene, α-chlorostyrene, vinylxylenes and vinylnaphthalenes. It is preferred that the above styrene monomer is copolymerized with other ethylenically unsaturated fatty acid or an acrylic monomer.

The acrylic monomer is expressed by a formula $CH_2{=}C(R_3)COOR_4$, wherein $R_3$ is a hydrogen atom or a lower alkyl group, $R_4$ is a hydrogen atom or an alkyl group, a hydroxyalkyl group, a polyolalkyl group, an epoxy-containing alkyl group, an alkoxyalkyl group or an aminoalkyl group. Its examples include an ethylacrylate, a methyl methacrylate, a butyl methacrylate, a 2-ethylhexyl acrylate, a 2-ethylhexyl methacrylate, a hydroxyethyl (meth)acrylate, a hydroxypropyl (meth-)acrylate, an aminomethyl (meth)acrylate, an acrylic acid, and a methacrylic acid. It is further allowable to use a polyacrylic monomer as an acrylic monomer in order to improve the cross-linking property as well as to use those in which $R_3$ and $R_4$ are polyalkyl groups or epoxy-containing alkyl groups.

Examples of the ethylenically unsaturated carboxylic acid and anhydrides thereof include an anhydrous maleic acid, a crotonic acid, and itaconic acid, and the like.

To fulfill the object of the present invention, it is particularly desired to sue a styrene-acrylic copolymer resin or the styrene-acrylic copolymer resin which is further copolymerized with the ethylenically unsaturated carboxylic acid. It is desired that the styrene-acrylic copolymer resin includes styrene in an amount of 20 to 80% by weight and alkyl(meth)acrylate in an amount of 20 to 80% by weight.

The crosslinking agent is suitably used to fit the above monomers. Its examples include a polymerizable crosslinking agent such as polyacrylate having a plurality of reaction sites, or a crosslinkable binder that is capable of forming crosslinked bonds among the high molecules such as the one having an isocyanate group, a reactive chloro (e.g., triazine chloro), a vinylsulfone group, a vinylketone group, an imine, an epoxy group, a mesylate, or an azido group. Concrete examples of the crosslinkable binder include diisocyanate, divinylsulfone, glyoxal and the like.

(Magnetic Powder)

The magnetic powder may be a ferrite or a magnetite of iron powder. Generally, however, a magnetite is preferred. The magnetic powder should desirably have a particle diameter of from 0.05 to 10 μm, and particularly from 0.1 to 2 μm. As a ferrite, there have heretofore been used sintered ferrite particles of a composition consisting of one or two or more of zinc iron oxide ($ZnFe_2O_4$), an yttrium iron oxide ($Y_3Fe_5O_{12}$), a cadmium iron oxide ($CdFe_2O_4$), a gadolinium iron oxide ($GdFe_5O_{12}$). a lead iron oxide ($PbFe_{12}O_{19}$), a nickel iron oxide ($NiFe_2O_4$), a neodymium iron oxide ($NdFeO_3$), a barium iron oxide ($BaFe_{12}O_{19}$), magnesium iron oxide ($MgFe_2O_4$), and a lanthanum iron oxide ($LaFeO_3$). Particularly, use is made of a soft ferrite containing at least one, or preferably, two or more kinds of metal components selected from the group consisting of Cu, Zn, Mg, Mn and Ni, such as a copper-zinc-magnesium ferrite.

It is desired that the magnetic powder is made present in an amount of 10 to 90% by weight and, particularly, in an amount of 40 to 80% by weight with respect to the total weight of the monomer. When the content of the magnetic powder becomes smaller than the above range, the magnetic powder is not sufficiently attracted by the developing sleeve, and the carrier drawing takes place easily. As the content of the magnetic powder exceeds the above range, furthermore, the weight is not sufficiently reduced and the strength of the powder decreases.

(Resin-Magnetic Spherical Particles)

The resin-magnetic spherical particles are obtained by polymerizing one or two or more of the above monomers in which are dispersed the magnetic powder and, as required, a crosslinking agent is blended such that the polymerized resin exhibits a glass transition temperature of higher than 100° C., and particularly, higher than 120° C. To use as a carrier for the developing agent, furthermore, the polymerized particles should have a nearly spherical shape without corners and should have an average particle size that lies within a range of 30 to 300 μm. The suspension polymerization method is desirable to obtain the polymer particles. In the suspension polymerization, for instance, the dispersion medium may be a water-soluble or a polar solvent which is widely known per se, and it is allowable to use a surface active agent or a dispersion stabilizer for the suspension granulation. The surface active agent may be the one that is widely known per se, and its examples include fatty acid-type and sulfonic acid-type anionic surface active agents. The dispersion stabilizer may be a sparingly soluble inorganic salt or the like.

The suspension granulation is carried out by using a high-speed shearing stirrer such as a homo-mixer, a homogenizer or the like, and the granular diameters should be set to a range that covers the above-mentioned average particle sizes. In carrying out the suspension granulation, the aforementioned polymerizable monomer in which the magnetic powder is directly dispersed may be subjected to the granulation, or a monomer which is polymerized to some extent into the form of a syrup-like prepolymer in which the magnetic powder is dispersed may be subjected to the granulation. It is desired that the stirring is forcibly carried out during the granulation in order to prevent the magnetic powder from sedimenting. In this regard, it is desired to subject a prepolymer having an increased viscosity such as an acrylic syrup in which the magnetic powder is dispersed to the suspension granulation.

(Surface-Treated Coating Layer)

When the resin-magnetic spherical particles are to be provided with a surface-treated coating layer of a resin, a resin which is known per se may be used. Desirably, however, there should be used a resin which adheres uniformly and strongly to the surfaces of the particles and which sufficiently maintains or adjusts the electrically charging property as a carrier.

Examples of the resin to be applied include a melamine resin, an epoxy resin, an acrylic resin, an alkyd resin and a silicone resin which can be used alone or in combination to meet the electrically charging property. In particular, it is desired to use a silicone type resin from the standpoint of homogeneity, adhesiveness and electric properties required for a carrier for a developing agent.

Concrete examples of the silicone type resin include an ordinary alkyl type silicone resin and, desirably, an acrylic-modified silicone resin, an oil, an amino group-containing silicone resin, or a coupling agent, a modified amino silicone resin, and oil. It is particularly desired to use an amino-modified silicone oil or an amino group-containing silane coupling agent from the standpoint of controlling the electric charging.

It is further possible to coat the resin-magnetic spherical particles with a silicone oil or a silane coupling agent instead of the reactive silicone resin, presenting advantage of intimate adhesiveness between the coating layer and the particles.

The resin can be directly applied to the resin-magnetic spherical particles using a conventional coating device such as a fluidized bed, a spray drier or a kneader coater. Here, it is important to heat-treat the coating layer at a temperature which is higher than 100° C. and, particularly, higher than 120° C. In this case, the solvent contained in the coating solution can be removed from the coating layer almost completely, and the coating layer can be sufficiently cured to form a layer which is strong and has excellent electrically charging property.

Moreover, it is desired to adjust the thickness of the surface-treated coating layer to lie within a range of from 0.1 to 3 μm though it may vary depending on the kind of the resin that is applied. The thus obtained particles should have an electrically charging amount of from −10 to −30 μc/g from the standpoint of a carrier for a developing agent.

(Developing Agent)

As a toner that can be used in combination with the carrier for the developing agent of the present invention, there can be used any conventional electroscopic toner which is obtained by dispersing a color-developing pigment, charge control agent and the like in binder resin without any limitation.

As a binder resin, there can be used a thermoplastic resin, or an uncured thermosetting resin or a thermosetting resin of an initial condensation product. Preferred examples include a vinyl aromatic resin such as polystyrene, an acrylic resin, a polyvinyl acetal, a polyester, an epoxy resin, a phenol resin, a petroleum resin, and an olefin resin.

As a coloring agent, there can be used a variety of pigments such as a carbon black, a quinacridone type pigment, a Rhodamine type pigment, a thioindigo pigment, and azo type pigment, a phthalocyanine type pigment, a nitro type pigment, or C.I. Solvent Red 49, C.I. Solvent Red 19, C.I. Solvent Blue 70, C.I. Solvent Yellow 19, C.I. Solvent Yellow 21, or the like.

As a control agent, there can be used, as required, an oil-soluble dyestuff such as Nigrosine Base (CI 50415), Oil Black (CI 26150), or a metal complex such as a metal-containing azo dyestuff, or a metal salt of salicylic acid, naphthoic acid or fatty acid.

The electroscopic toner particles used in the present invention should be desirably have particle sizes, i.e., median diameters of 5 to 35 μm and, particularly, 7 to 20 μm.

It is desired that the magnetic carrier and the toner are mixed together at a ratio of 85% by weight or more and, particularly, 90 to 95% by weight for the magnetic carrier and 15% by weight or less and, particularly, 5 to 10% by weight for the toner, thereby to obtain a two-component type developing agent. When such a developing agent is mixed and stirred, the carrier in the developing agent is electrically charged to a suitable degree, and is fed together with the toner onto the developing sleeve which has a magnet inside therein, brought in contact with the surface of a photosensitive member having electrostatic images and where the toner only is electrically attracted by the surface of the photosensitive member. On the other hand, the carrier of the developing agent returns again into the stirrer and is stirred together with the toner. The carrier of the developing agent according to the present invention has flowability, durability and resistance against the heat, and is excellent adapted to the apparatus and is not degenerated. Even under the electrically charged condition, the carrier does not change with the lapse of time and exhibits excellent stability even under high-temperature and high-humidity environmental conditions. Therefore, the formed images has excellent image concentrations without fogging on the surface.

EXAMPLES

The invention will now be described by way of examples.

EXAMPLE 1

(Preparation of a carrier)

100 Parts by weight of particles (resin: crosslinked methyl polymethacrylate, magnetic powder content: 50%, average particle size: 100 μm, glass transition temperature: 200° C. or higher, produced by Sekisui Kaseihin Kogyo Co., tradename Techpolymer "MBX") prepared by the polymerization method as resin particles of the type in which a magnetic powder was dispersed, were coated with 0.5 parts by weight of a silicone resin (produced by Sin-etsu Kagaku Co., tradename KR-255) using a fluidized coating device followed by the heat treatment at 150° C. for two hours with stirring to obtain the carrier of the present invention.

(Preparation of a toner)

100 Parts by weight of a styrene acrylic resin, 10 parts by weight of carbon black (produced by Mitsubishi Kasei Co., tradename MA-100), 1 part by weight of a charge control agent (produced by Orient Kagaku Co., tradename Bontron S-34), and 2 parts by weight of a polypropylene (produced by Sanyo Kasei Co., tradename Viscol 550p) were mixed together, melted and were kneaded. The mixture was then pulverized using a jet mill and was classified to obtain a powder having an average particle size of 11 μm.

100 Parts by weight of the above powder was surface-treated with 0.2 parts by weight of a hydrophobic silica (produced by Nippon Aerosil Co., tradename $R_{972}$) using the Henscel's mixer to obtainer a toner. Three parts by weight of the above toner and 97 parts by weight of the carrier were mixed together to prepare a developing agent. A change with the passage of time and environmental characteristics of the developing agent were evaluated in a manner as described below and were listed in Tables 1 and 2.

(Change with the passage of time)

The amounts of electric charge of the developing agents just after the preparation and ten days after the preparation were measured using a blow-off method, and the coagulating conditions were judged by naked eyes.

(Environmental characteristics)

The amounts of electric charge of the developing agents were measured by the blow-off method under the conditions of a low temperature and a low humidity (10° C., 30%), a medium temperature and a medium humidity (20° C., 60%), and a high temperature and a high humidity (30° C., 90%), and the amounts of water content were measured using the Karl Fischer's water content meter.

EXAMPLE 2

A developing agent was prepared in the same manner as in Example 1 with the exception of using a carrier obtained by using a silicone oil (produced by Shin-etsu Kagaku Co., tradename KF-99) instead of using the silicone resin (produced by Shin-etsu Kakagu Co., tradename KR-255), and was evaluated.

EXAMPLE 3

A developing agent was prepared in the same manner as in Example 1 with the exception of using a carrier obtained by using an amino-modified silicone oil (produced by Shin-etsu Kagaku Co., KF-393) instead of using the silicone resin (produced by Shin-etsu Kagaku Co., tradename KR-255), and was evaluated.

EXAMPLE 4

A developing agent was prepared in the same manner as in Example 1 with the exception of using a carrier obtained by using a silane coupling agent (produced by Shin-etsu Kagaku Co., tradename KBE-1003) instead of using the silicone resin (produced by Shin-etsu Kagaku Co., tradename KR-255), and was evaluated.

EXAMPLE 5

A developing agent was prepared in the same manner as in Example 1 with the exception of using a carrier obtained by using an amino group-containing silane coupling agent (produced by Shin-etsu Kagaku Co., tradename KBE-603) instead of using the silicone resin (produced by Shin-etsu Kagaku Co., tradename KR-255), and was evaluated.

COMPARATIVE EXAMPLE 1

A developing agent was prepared in the same manner as in Example 1 with the exception of using a carrier obtained by using particles (produced by Powdertech Co.) produced by the melt-spray-quenching method as resin particles of the type in which the magnetic powder was dispersed, and was evaluated.

COMPARATIVE EXAMPLE 2

A developing agent was prepared in the same manner as in Comparative Example 1 with the exception of using a carrier obtained by coating the carrier particles with 0.5 parts by weight of a silicone resin (produced by Shin-etsu Kagaku Co., tradename KR-255) using a fluidized coating device without effecting the heat treatment, and was evaluated.

COMPARATIVE EXAMPLE 3

A developing agent was prepared in the same manner as in Comparative Example 2 with the exception of using a carrier prepared by using a silicone oil (produced by Shin-etsu Kagaku Co., tradename KF-99) instead of using the silicone resin (Shin-etsu Kagaku Co., tradename KR-255), and was evaluated.

COMPARATIVE EXAMPLE 4

A developing agent was prepared in the same manner as in Comparative Example 2 with the exception of using a carrier prepared by using an amino-modified silicone oil (Shin-etsu Kagaku Co., tradename KF-393) instead of using the silicone resin (Shin-etsu Kagaku Co., tradename KR-255), and was evaluated.

COMPARATIVE EXAMPLE 5

A developing agent was prepared in the same manner as in Comparative Example 2 with the exception of using a carrier obtained by using a silane coupling agent (Shin-etsu Kagaku Co., KBE-1003) instead of using the silicone resin (Sin-etsu Kagaku Co., tradename KR-255), and was evaluated.

COMPARATIVE EXAMPLE 6

A developing agent was prepared in the same manner as in Comparative Example 2 with the exception of using a carrier obtained by using an amino group-containing silane coupling agent (Shin-etsu Kagaku Co., tradename KBE-603) instead of using the silicone resin (Shin-etsu Kagaku Co., tradename KR-255), and was evaluated.

The above results are shown in Tables 1 and 2.

TABLE 1

| | Amount of electric charge (−μc/g) | | Coagulation | |
|---|---|---|---|---|
| | ①* | ②** | ①* | ②** |
| Example 1 | 19.7 | 18.2 | | |
| Example 2 | 21.6 | 20.9 | | |
| Example 3 | 28.8 | 28.5 | | |
| Example 4 | 24.1 | 25.1 | | |
| Example 5 | 29.6 | 27.2 | | |
| Comparative Example 2 | 15.2 | 9.3 | | X |
| Comparative Example 3 | 20.9 | 12.1 | X | X |
| Comparative Example 4 | 24.1 | 12.5 | X | X |
| Comparative Example 5 | 23.5 | 12.8 | | X |
| Comparative | 25.2 | 16.8 | | X |

TABLE 1-continued

| | Amount of electric charge (−μc/g) | | Coagulation | |
|---|---|---|---|---|
| | ①* | ②** | ①* | ②** |
| Example 6 | | | | |

Note
*①: Developing agents just after preparation.
**②: Developing agents ten days after preparation.
: Not coagulated.
X: Coagulated.

TABLE 2

| | Water content (%) | | | Amount of electric charge (−μc/g) | | |
|---|---|---|---|---|---|---|
| | I | II | III | I | II | III |
| Example 1 | 0.01 | 0.01 | 0.01 | 22.6 | 19.5 | 18.2 |
| Example 2 | 0.01 | 0.01 | 0.01 | 22.6 | 22.8 | 21.8 |
| Example 3 | 0.02 | 0.02 | 0.02 | 30.2 | 29.1 | 27.6 |
| Example 4 | 0.01 | 0.01 | 0.01 | 25.6 | 24.0 | 23.1 |
| Example 5 | 0.01 | 0.02 | 0.02 | 31.1 | 31.0 | 28.2 |
| Comparative Example 2 | 0.03 | 0.03 | 0.04 | 19.6 | 15.2 | 12.1 |
| Comparative Example 3 | 0.04 | 0.04 | 0.06 | 22.8 | 21.0 | 19.2 |
| Comparative Example 4 | 0.08 | 0.09 | 0.15 | 27.2 | 23.6 | 12.7 |
| Comparative Example 5 | 0.04 | 0.06 | 0.06 | 26.7 | 22.5 | 13.6 |
| Comparative Example 6 | 0.09 | 0.10 | 0.16 | 27.8 | 25.2 | 10.1 |

Note:
I: Low temperature, low humidity.
II: Intermediate temperature, intermediate humidity.
III: High temperature, high humidity.

When the carrier was heat-treated in Comparative Example 1, the resin particles were melted and the blocking took place. Therefore, the developing agent could not be evaluated. As is obvious from Table 1, furthermore, the developing agents obtained in Comparative Examples 2 to 6 greatly lost the amount electric charge ten days after their preparation, and coagulated, too. On the other hand, the developing agents obtained in Examples 1 to 5 exhibited favorable charging property without almost any change even after the passage of time, and did not coagulate.

As will be obvious from Table 2, furthermore, the developing agents obtained in Comparative Examples 2 to 6 possessed large water contents which further increased with an increase in the temperature and the humidity, and further greatly lost the electric charge, manifesting that their properties were subject to greatly change depending upon the environment.

The developing agents obtained in Examples 1 to 5, on the other hand, possessed small water contents, and exhibited small change in the water content and the amount of electric charge irrespective of an increase in the temperature and the humidity, and were not subject to change depending on the environment.

Using the developing agents obtained in Example 1 and in Comparative Example 2, 30,000 pieces of copies were obtained by using an electrophotocopying machine, Model DC-2055 (produced by Mita Kogyo Co.) in order to evaluate the toner scattering, charging characteristics and the image characteristics such as image concentration (ID) and surface fogging (FD). The results were as shown in Table 3.

Toner scattering: After 30,000 pieces of copies were obtained, the interior of the developing device was observed.

ID and FD: Measured using a device, Model TC-60 manufactured by Tokyo Denshoku Co.

Amount of electric charge: Measured by the blow-off method.

TABLE 3

| | ID | | FD | | Amount of electric charge (−μc/g) | | Toner scattering |
|---|---|---|---|---|---|---|---|
| | i* | ii** | i* | ii** | i | ii | |
| Example 1 | 1.41 | 1.39 | 0.002 | 0.002 | 19.7 | 19.5 | |
| Comparative Example 2 | 1.42 | 1.50 | 0.003 | 0.013 | 15.2 | 8.2 | X |

Note:
*i: Evaluation before 30,000 pieces of copies were obtained.
**ii: Evaluation before 30,000 pieces of copies were obtained.
: Toner scattered.
X: Toner did not scatter.

As will be obvious from Table 3, the developing agent of Comparative Example 2 lost the amount of electric charge after 30,000 pieces of copies were obtained, developed large surface fogging, and offered poor image characteristics. The developing agent of Example 1, on the other hand, exhibited stabilized amount of electric charge even after 30,000 pieces of copies were obtained, and presented excellent image characteristics.

We claim:

1. A carrier for a developing agent comprising resin-magnetic spherical particles which are formed by the polymerization of a monomer in which a magnetic powder is dispersed and which have a glass transition temperature of higher than 100° C., the surfaces of said resin-magnetic spherical particles being coated with a surface-treated coating layer.

2. A carrier for a developing agent according to claim 1, wherein said surface-treated coating layer is formed on the surfaces of the resin-magnetic spherical particles by the heat treatment at a temperature higher than 100° C.

3. A carrier for a developing agent according to claim 1, wherein the magnetic powder-dispersed monomer is comprised of two or more kinds of polymerizable monomers, and a polymerized product thereof forms a copolymer.

4. A carrier for a developing agent according to claim 3, wherein said magnetic powder-dispersed monomer is a styrene-acrylic copolymer.

5. A carrier for a developing agent according to claim 1, wherein the magnetic powder is dispersed in the monomer in an amount of 10 to 90% by weight with respect to the total weight of the monomer.

* * * * *